US006250981B1

(12) United States Patent
Morikami

(10) Patent No.: US 6,250,981 B1
(45) Date of Patent: Jun. 26, 2001

(54) WATER JACKET STRUCTURE FOR AN OUTBOARD MOTOR

(75) Inventor: Tadaaki Morikami, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/459,902

(22) Filed: Dec. 14, 1999

(30) Foreign Application Priority Data

Dec. 24, 1998 (JP) ..... 10-367475

(51) Int. Cl.[7] ..... B63H 20/00
(52) U.S. Cl. ..... 440/88; 123/41.31
(58) Field of Search ..... 440/88; 123/41.31

(56) References Cited

U.S. PATENT DOCUMENTS 5,078,627 * 1/1992 Anderson ..... 440/1
5,694,895 * 12/1997 Tsunoda et al. ..... 123/179.24
5,715,777 * 2/1998 Wada et al. ..... 123/41.09
5,829,402 * 11/1998 Takahashi et al. ..... 123/184.24

FOREIGN PATENT DOCUMENTS 4-39194 * 2/1992 (JP) .
10-47221 2/1998 (JP) .
10-223124 8/1998 (JP) .

* cited by examiner

*Primary Examiner*—Sherman Basinger
(74) *Attorney, Agent, or Firm*—Finnegan, Henderson, Farabow, Garrett & Dunner, L.L.P.

(57) ABSTRACT

A water jacket device for an outboard motor is designed to accommodate electrical components and improve cooling efficiency. The water jacket device has a base portion, and a cover portion hermetically coupled to the base portion for retaining a fluid between the base portion and the cover portion. The cover portion has an portion integrally formed with the cover portion, for installing an electrical component so that the electrical component is configured to be cooled by the fluid.

4 Claims, 4 Drawing Sheets

WATER JACKET STRUCTURE FOR AN OUTBOARD MOTOR

CROSS REFERENCE TO RELATED APPLICATION

The present application claims priority from Japanese Patent Application No. Hei 10-367475, the content of which is incorporated herein by reference.

BACKGROUND OF THE INVENTION

The present invention relates to a water jacket structure for an outboard motor. More particularly, the invention concerns a water jacket structure having an installation portion for installing an electrical component of an outboard motor.

Generally, an outboard motor has an intake system, an exhaust system, and electrical components around an engine of the outboard motor, and these systems, and components are enclosed by an engine cover. The electrical components are exothermic bodies. Also, the electrical components are often exposed to heat from the engine. Because the electrical components are exposed to extremely high temperatures, ample cooling is necessary to ensure the operation of the electrical components.

A common method of cooling the electrical components is to provide radiator fins in a housing case of the electrical components, and to expose this case to cool air from, for example, a flywheel. Cooling electrical components by the cool air from the flywheel, however, does not necessarily provide an adequate cooling effect. Without adequate cooling, the efficiency of the electrical components decreases, or in some instances, the electrical components may break down. The radiator fins may be enlarged to increase its cooling efficiency. However, the enlarged radiator fins increase the housing size of the electrical components, and take up more space in the outboard engine.

Furthermore, radiated heat from the electrical components and the size of the electrical component increase as the capacity of the electrical components increases. Because an adequate distance must be obtained between the electrical components and other parts of the outboard motor, it becomes difficult to design the component layout of the outboard engine.

SUMMARY OF THE INVENTION

One object of the invention is to provide a structure for installing electrical components in an outboard engine to improve cooling efficiency.

The objects of the invention are to provide an air intake device for an outboard motor, that is simple to manufacture and prevents a large volume of fuel vapor from flowing into an engine intake system.

Additional objects and advantages of the invention will be set forth in part in the description which follows, and in part will be obvious from the description, or may be learned by practice of the invention. The advantages and purpose of the invention will be realized and attained by the elements and combinations particularly pointed out in the appended claims.

To attain the advantages and in accordance with the purposes of the invention, as embodied and broadly described herein, a water jacket device for cooling an exhaust passage of an outboard motor includes a base portion, and a cover portion hermetically coupled to the base portion for retaining a fluid between the base portion and the cover portion. The cover portion has an portion integrally formed with the cover portion, for installing an electrical component so that the electrical component is configured to be cooled by the fluid.

In another aspect of the invention, the objects and advantages of the invention are attained by the cover portion including an inner surface having a cooling fin.

In yet another aspect of the invention, the objects and advantages of the invention are attained by the cover portion including an outer surface having a cooling fin.

In still another aspect of the invention, the objects and advantages of the invention are attained by the cover portion having a first temperature sensor for sensing a temperature of the cover portion and a second temperature sensor for sensing a cylinder bock of the outboard motor, the first and second temperature sensors connected to a controller to provide values of the sensed temperatures.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENTS

Reference will now be made in detail to the present preferred embodiment of the invention, an example of which is illustrated in the accompanying drawings. Wherever possible, the same reference numbers will be used throughout the drawings to refer to the same or like parts.

The present invention is directed to a water jacket device for cooling an exhaust passage of an outboard motor. The water jacket device includes a base portion, and a cover portion hermetically coupled to the base portion for retaining a fluid between the base portion and the cover portion. The cover portion has an portion integrally formed with the cover portion, for installing an electrical component so that the electrical component is configured to be cooled by the fluid.

Figure 1:
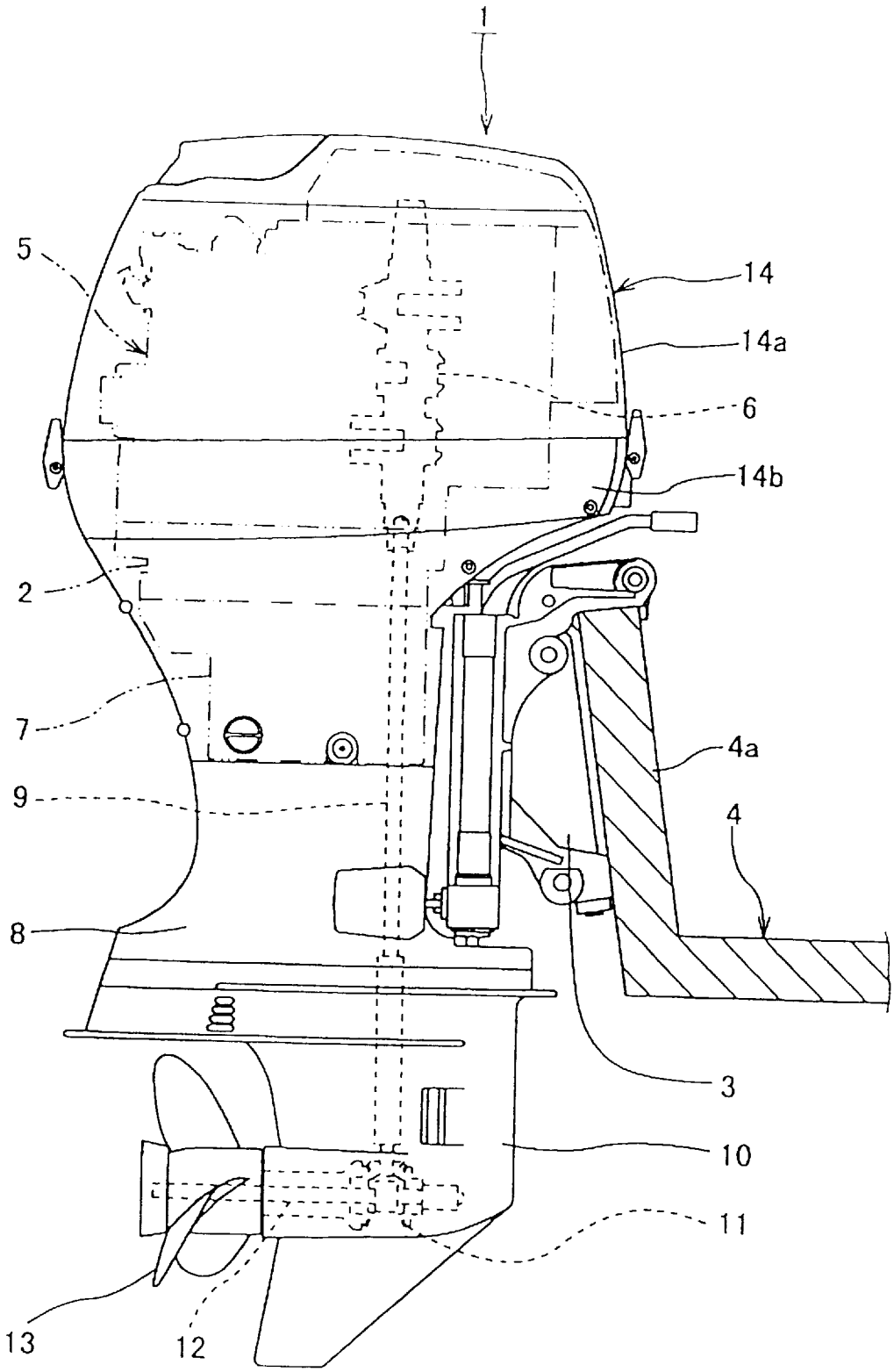
FIG. 1 is a side cross-sectional view of an outboard motor illustrating one embodiment of a installation portion according to the invention.

FIG. 1 illustrates a side view of an outboard motor, denoted by reference numeral 1, according to one embodiment of the present invention. The outboard motor 1 typically has an engine holder 2 and a bracket 3 attached to the engine holder 2, and can be mounted onto a transom 4*a* of a hull 4 by the bracket 3. The outboard motor 1 also has an engine 5 installed on the engine holder 2. The engine 5 has a crank shaft 6 such that the axis of the crank shaft is oriented in a vertical direction.

The outboard motor 1, moreover, has an oil pan 7 and a shaft housing 8 in the lower part of the engine holder 2. A drive shaft 9 is connected to the lower end of the crank shaft 6 and extends downwardly through the oil pan 7 and the shaft housing 8. The drive shaft 9 is coupled to a propeller shaft 12 via a bevel gear 11 housed in a gear case 10 located below the shaft housing 8. The propeller shaft 12 is connected to a propeller 13 and drives the propeller 13.

The engine 5 is fully enclosed by an engine cover 14. The engine cover 14 includes an upper cover 14*a* and a lower cover 14*b* separable from each other. The lower cover 14*b* may be divided into a left-side cover and a right-side cover. The engine holder 2, the oil pan 7, and other components located at the bottom part of the engine are enclosed by the lower cover 14*b*, while the upper part of the engine 5 is enclosed by the upper cover 14*a*.

Figure 2:
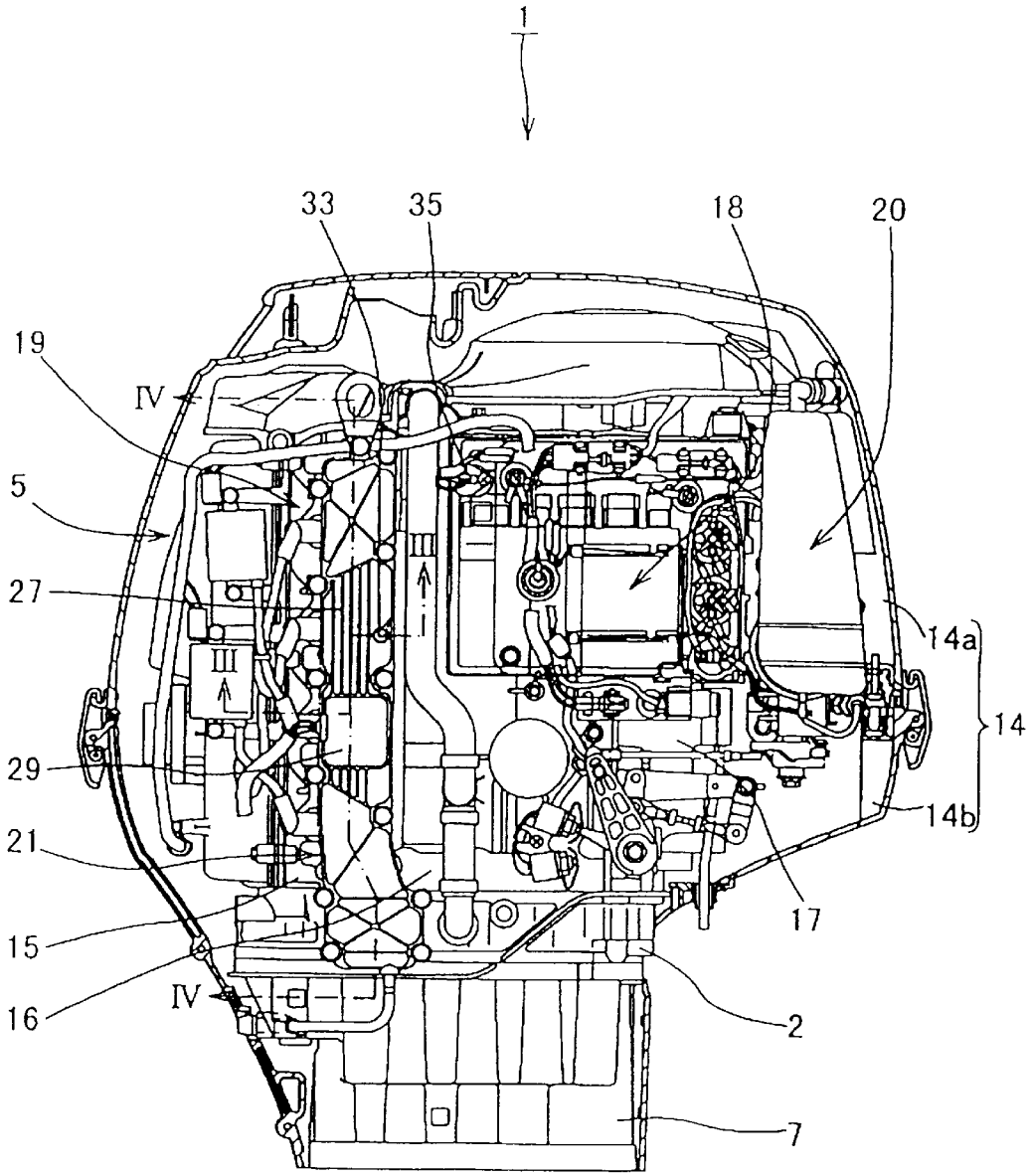
FIG. 2 is a side view of an enlargement of the engine component of FIG. 1.
Figure 3:
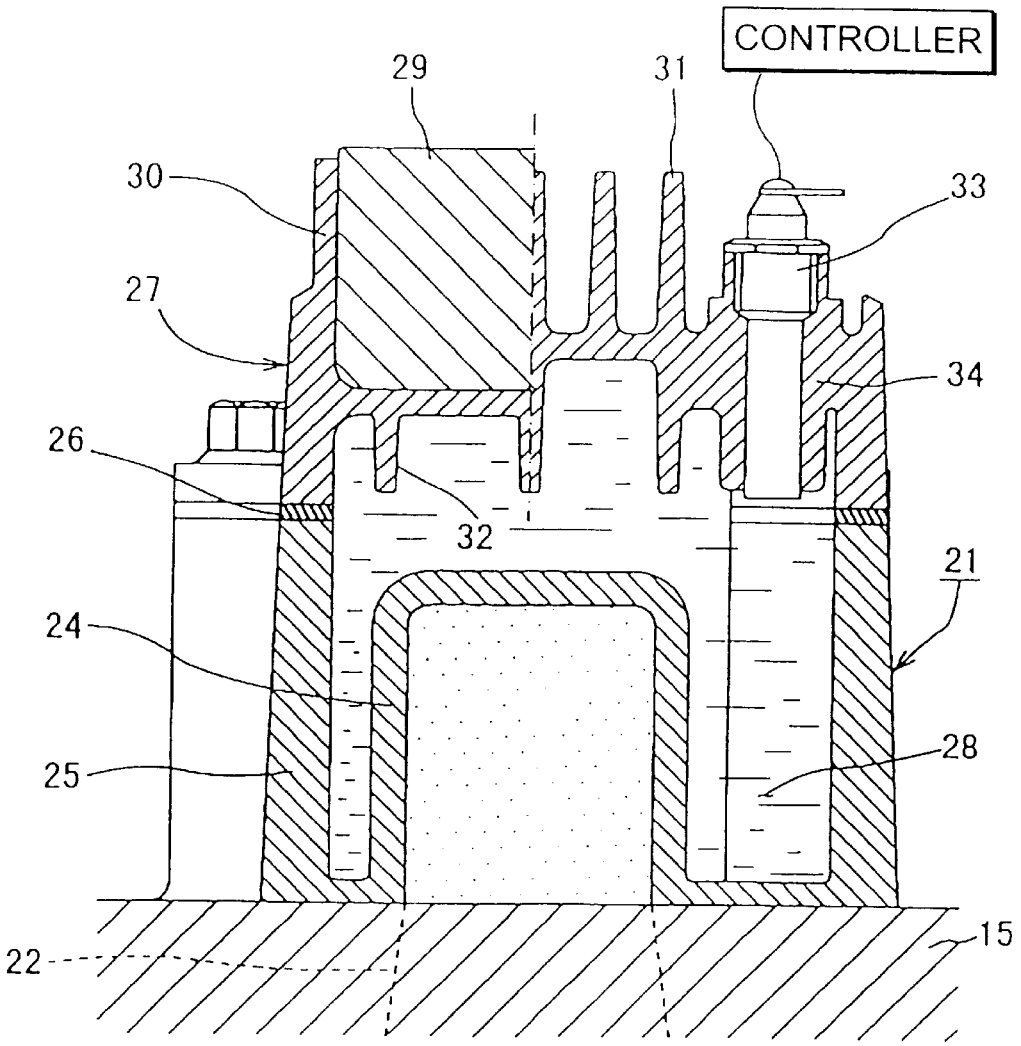
FIG. 3 is a cross-sectional diagram cut along line III—III found in FIG. 2.

FIG. 2 illustrates a side view of the engine 5 of FIG. 1. The engine cover 14 is shown in a cross-sectional profile in FIG. 2. FIG. 3 is a cross-sectional view of the engine 5 along the line III—III in FIG. 2, and FIG. 4 is a cross-sectional view of the engine 5 along the line IV—IV in FIG. 2.

As can be seen in FIG. 2, the engine 5 may be, for example, a water-cooled, four-cycle, four-cylinder engine, and has a cylinder head 15, a cylinder block 16, and a crank case 17 oriented horizontally. Electrical components 18, an exhaust system 19, an intake system 20 are located near the engine 5. While the intake system 20 is compactly arranged from the left side (not shown in the figure) to the front side of the engine 5, the exhaust system 19 is located on the right side of the engine 5. Similar to the exhaust system 19, the electrical components 18 are compactly arranged on the right side of the engine 5. The exhaust system 19 has an exhaust manifold 21 supported by a side of the cylinder head 15 and a side of the engine holder 2.

Figure 4:
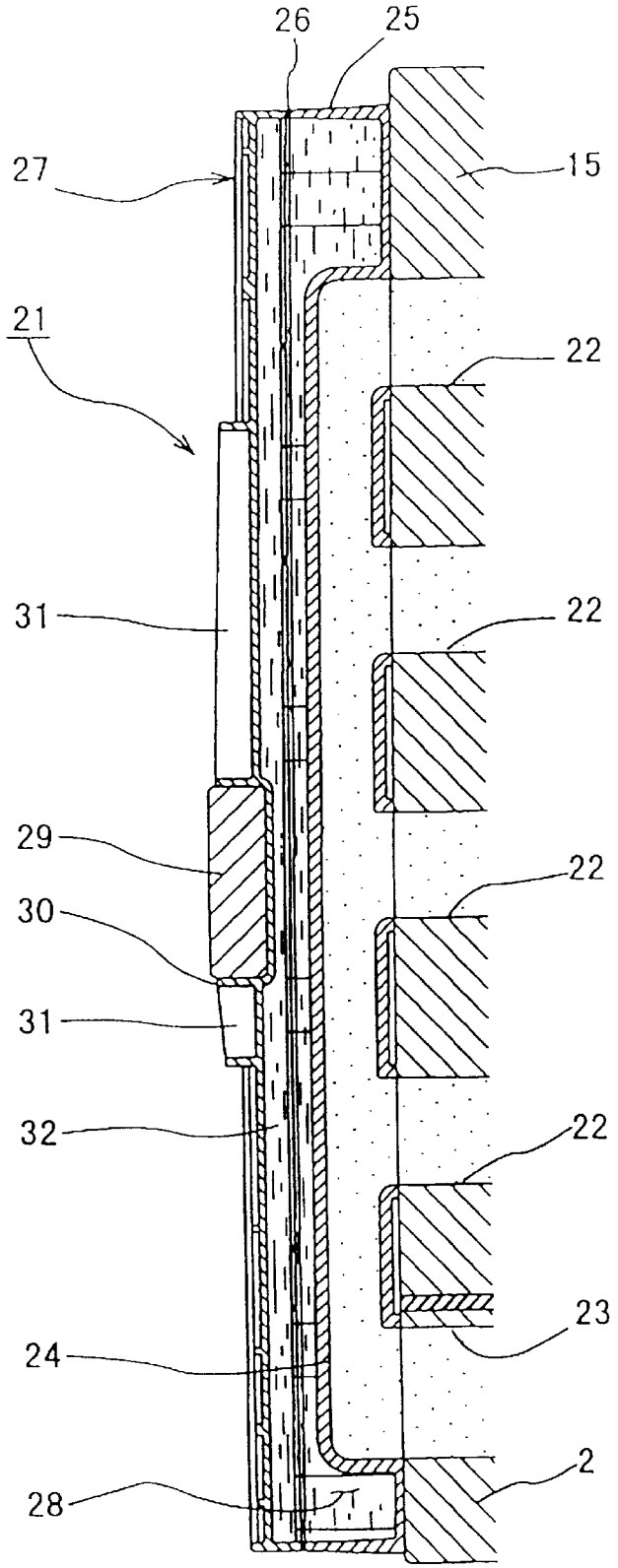
FIG. 4 a cross-sectional figure cut along line IV—IV found in FIG. 2.

As illustrated in FIGS. 2–4, the exhaust manifold 21 has an exhaust passage 24 that connects an exhaust port 22 formed in the cylinder head 15 and an exhaust emission path 23 formed in the engine holder 2. A wall 25 is integrally formed with the exhaust passage 24 in the periphery of the exhaust passage 24, defining a base portion. The base portion is hermetically coupled with a lid portion 27, which is a cover portion, via a sealant 26. The base portion and the lid portion form a water jacket 28 to cool the exhaust passage 24 inside.

The lid portion 27 has an installation portion 30 integrally formed with the lid portion 27 for installing the electrical components 29, such as a rectifier and a regulator. The electrical components 29 are preferably installed as a single unit in the installation portion 30.

A plurality of heat-radiation fins 31 may be integrally formed with the lid portion 27 on the external side of the lid portion 27 near the installation portion 30. Also, a plurality of cooling fins 32 are integrally formed with the lid portion 27 on the internal side of the lid portion 27. These cooling fins 32 are arranged along the direction of the cooling liquid flow, which is the vertical direction in FIG. 3.

The lid portion 27 has an attachment portion 34 for attaching a temperature sensor 33 for detecting a temperature of the lid portion 27. The temperature sensor 33 can be coupled to the attachment portion 34 from outside. As illustrated in FIG. 2, another temperature sensor 35 can be installed to the cylinder block 16 to detect a temperature of the cylinder block 16. Both temperature sensors 33, 35 are linked to a central processing unit (CPU) (not shown in the figures) and measured temperature values may be transmitted to the CPU so that malfunction of the electrical components 29 or deficiency of the coolant can be easily detected.

The operation of this water jacket structure for an outboard motor is explained below.

The lid portion 27 has the installation portion 30 integrally formed with the lid portion 27, for installing the electrical components 29, and the electrical components 29 are installed preferably as a single unit in this installation portion 30. Thus, the electrical components 29 are cooled by the coolant that also cools the exhaust passage 24. This coolant used to cool the exhaust passage 24 continuously flows within the water jacket 28. As a result, the operating efficiency of the electrical components 29 improves by the stable cooling capability.

Also, the cooling fins 32 are formed on the internal side of the lid portion 27, and the cooling fins 32 improve cooling efficiency. Moreover, the cooling fins fins 31 are formed on the external side of the lid portion 27, and the cooling fins 31 improve the cooling efficiency of the electrical components 29. Therefore, the electrical components are efficiently cooled, and the cooling efficiency may not dramatically decrease ever if there is insufficient coolant.

The temperature sensor 33 that detects the temperature of the lid potion 27 is installed in the lid portion 27, and the temperature sensor 35 that detects the temperature of the cylinder block 16 is installed in the cylinder block 16. As stated before, the temperature sensors 33, 35 are linked to a central processing unit (CPU) and malfunction of the electrical components 29 or deficiency of the coolant can be easily detected. For example, if the temperature sensor 35 detects a steady cylinder block temperature but the temperature sensor 33 detects the increasing temperature of the lid portion 27, then it can be determined that there is a malfunction in the electrical components 29. On the other hand, if the values of both temperature sensors 33, 35 increase, it can be determined that there is insufficient coolant.

Because the temperature sensors 33, 35 are positioned at different engine locations, abnormal conditions can be determined more easily. Also, because the installation portion 30 and the electrical components 29, which are conventionally located apart, as well as the radiator fins 31 and the cooling fins 32 are formed integrally with the lid portion, the number of parts is greatly reduced, and the layout is improved.

The water jacket device of this invention is provided to adequately cool the exhaust passage and electrical components by the coolant. Thus, the operational efficiency of the electrical components increases. Because the cooling fins are formed on the internal side of the lid component, moreover, the cooling efficiency of the electrical components is improved and the number of engine parts can be decreased. Also, because the cooling fins are formed on the external side of the lid component, the cooling efficiency of the electrical components further improves. Even if there is insufficient coolant, the cooling efficiency may be maintained at a satisfactory level. This structure of the cooling fins also help reduce the required engine parts.

Additionally, the temperature sensor is installed in the lid portion detect the temperature of this lid portion, and another temperature sensor is installed in the cylinder block to detect the temperature of the cylinder block. By linking these temperature sensors to a CPU, the temperature of the lid portion and the cylinder block can be easily detected, and malfunction of the engine can be detected easily.

It will be apparent to those skilled in the art that various modifications and variations can be made in the water jacket device of the present invention and in construction of this device without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A water jacket device for cooling an exhaust passage of an outboard motor, the water jacket device comprising:

a base portion; and a cover portion hermetically coupled to the base portion for retaining a fluid between the base portion and the cover portion, the cover portion having an portion integrally formed with the cover portion, for installing an electrical component so that the electrical component is configured to be cooled by the fluid, wherein the cover portion has a first temperature sensor proximate the electrical component, for sensing a temperature of the cover portion and a second temperature sensor for sensing a cylinder block of the outboard motor, the first and second temperature sensors connected to a controller to provide values of the sensed temperatures.

2. The water jacket device of claim 1, wherein the cover portion includes an inner surface having a cooling fin.

3. The water jacket device of claim 1, wherein the cover portion includes an outer surface having a cooling fin.

4. A water jacket device for cooling an exhaust passage of an outboard motor, the water jacket device comprising:

a base portion;

a cover portion hermetically coupled to the base portion to define a fluid passage for retaining a fluid between the base portion and the cover portion, the cover portion having an electrical component installation portion integrally formed with the cover portion, for installing an electrical component so that the electrical component is configured to be cooled by the fluid;

a first temperature sensor for sensing a temperature of the cover portion, the first temperature sensor being, installed proximate the electrical component installation portion at the cover portion to determine a malfunction of the electrical component; and a second temperature sensor installed at the cylinder bock of the outboard motor.

* * * * *